US012194338B2

(12) United States Patent
Lorusso et al.

(10) Patent No.: US 12,194,338 B2
(45) Date of Patent: Jan. 14, 2025

(54) FOLDABLE GYMNASTIC MACHINE

(71) Applicant: TECHNOGYM S.P.A., Cesena (IT)

(72) Inventors: Marco Lorusso, Cesena FC (IT); Luca Benini, Cesena FC (IT); Roberto Gorza, Cesena FC (IT)

(73) Assignee: TECHNOGYM S.P.A., Cesena (IT)

( * ) Notice: Subject to any disclaimer, the term of this patent is extended or adjusted under 35 U.S.C. 154(b) by 284 days.

(21) Appl. No.: 17/810,403

(22) Filed: Jul. 1, 2022

(65) Prior Publication Data

US 2023/0001264 A1 Jan. 5, 2023

(30) Foreign Application Priority Data

Jul. 2, 2021 (IT) ..... 102021000017516

(51) Int. Cl.
*A63B 22/06* (2006.01)
*A63B 22/00* (2006.01)

(52) U.S. Cl.
CPC ..... *A63B 22/0664* (2013.01); *A63B 22/001* (2013.01); *A63B 2022/0682* (2013.01); *A63B 2210/50* (2013.01)

(58) Field of Classification Search
CPC ... A63B 21/0052; A63B 22/001; A63B 22/04; A63B 22/0664; A63B 71/0054; A63B 2022/0682; A63B 2210/50
See application file for complete search history.

(56) References Cited

U.S. PATENT DOCUMENTS 5,692,994 A * 12/1997 Eschenbach ..... A63B 22/001 482/57
5,782,722 A * 7/1998 Sands ..... A63B 22/0664 482/52
6,030,320 A * 2/2000 Stearns ..... A63B 22/0664 482/57

(Continued)

FOREIGN PATENT DOCUMENTS

EP 3159046 4/2017
WO WO 2019/089547 5/2019

OTHER PUBLICATIONS

Italian Search Report of Mar. 17, 2022 for Italian Patent Application No. 202100017516. 9 pages.

*Primary Examiner* — Joshua Lee
(74) *Attorney, Agent, or Firm* — Knobbe, Martens, Olson & Bear, LLP

(57) ABSTRACT

A foldable gymnastic machine comprising a supporting structure to rest said gymnastic machine on a resting surface, comprising a front portion, comprising a resistance member, and a rear portion, an exercise device, through which a user performs a gymnastic exercise, coupled to said supporting structure and to said resistance member, capable of resisting during the exercise, said exercise device comprising a second pair of levers for the feet, comprising a first and a second lever, each provided with a first end, coupled to said supporting structure, and a free second end, capable of fitting said user's feet during the exercise, said gymnastic machine being characterized in that said first and second lever of said second pair of levers are capable of passing from an open position, in which the user can perform the exercise, to a closed position, when the gymnastic machine is not in use.

11 Claims, 8 Drawing Sheets

(56) References Cited

U.S. PATENT DOCUMENTS 6,135,927 A * 10/2000 Lo ..... A63B 22/0664 482/52
6,149,551 A * 11/2000 Pyles ..... A63B 22/0664 482/52
6,190,289 B1 * 2/2001 Pyles ..... A63B 22/0664 482/52
7,060,005 B2 * 6/2006 Carlsen ..... A63B 22/001 482/52
7,462,135 B2 * 12/2008 Lo ..... A63B 22/001 482/52
7,513,855 B1 * 4/2009 Yeh ..... A63B 22/001 482/52
7,736,279 B2 * 6/2010 Dalebout ..... A63B 22/0664 482/52
7,766,797 B2 * 8/2010 Dalebout ..... A63B 22/0664 482/52
7,775,940 B2 * 8/2010 Dalebout ..... A63B 22/001 482/52
7,854,691 B2 * 12/2010 Long ..... A63B 22/001 482/52
7,946,962 B2 * 5/2011 Long ..... A63B 21/4035 482/52
8,944,966 B2 * 2/2015 Miller ..... A63B 22/0017 482/52
8,968,159 B2 * 3/2015 Johnson ..... A63B 22/001 482/52
9,067,094 B2 * 6/2015 Chang ..... A63B 22/0015
9,421,416 B2 * 8/2016 Mortensen ..... A63B 22/0664
9,498,672 B1 11/2016 Miller
2005/0277519 A1 12/2005 Moon
2006/0287161 A1 * 12/2006 Dalebout ..... A63B 22/001 482/52
2007/0129218 A1 * 6/2007 Dalebout ..... A63B 22/0664 482/52
2008/0200314 A1 * 8/2008 Dalebout ..... A63B 22/0664 482/52
2008/0280733 A1 * 11/2008 Dickie ..... A63B 22/001 482/52
2011/0039661 A1 * 2/2011 Long ..... A63B 21/4035 482/52
2012/0322624 A1 12/2012 Wu
2013/0310225 A1 * 11/2013 Johnson ..... A63B 22/203 482/52
2014/0296036 A1 * 10/2014 Miller ..... A63B 21/154 482/52

* cited by examiner

FOLDABLE GYMNASTIC MACHINE

CROSS-REFERENCE TO RELATED APPLICATIONS

This application claims priority to Italian Patent Application No. 102021000017516, filed on Jul. 2, 2021, the contents of which are incorporated herein by reference in its entirety.

TECHNICAL FIELD

The disclosure relates to a gymnastic machine, in particular an apparatus for cardiovascular training for the stationary simulation of walking and running, also known as an elliptical machine or trainer or cross-trainer.

More in detail, the disclosure relates to a foldable elliptical machine, designed and manufactured in particular to be used by the users at home, but which can be used in any type of context for which a compact gymnastic apparatus that occupies little space is required when not in use.

In the following the description will be directed to an elliptical gymnastic machine for domestic use, but it is clear that it should not be considered limited to this specific use.

BACKGROUND

As is well known, there are currently on the market gymnastic equipment with similar training functions, therefore useful for simulating running, walking, and climbing stairs with a reduced impact on the joints.

Usually said machines comprise a longitudinally extending ground support base, a vertical bearing structure, capable of supporting the levers that can be operated with the user's hands, and platforms to house the user's feet.

The use configuration of the machine is also called open configuration, while the configuration with a minimum footprint of the machine is also called closed configuration.

Among said known gymnastic equipment, there are also foldable machines, which therefore reduce the overall sizes of the machine itself when not in use.

In particular, there are machines of the above type provided with hinges, which allow the vertical support to rotate to approach the support base, thus reducing its overall height when not in use.

However, a disadvantage of said machines is that they have a considerable longitudinal footprint on the ground, thus reducing the domestic space that can be used for other purposes, even in the closed configuration.

In other machines, the transition from the open configuration to the closed configuration and vice versa is a very expensive operation in terms of energy and force to be exerted by a user.

Furthermore, to pass from the open configuration to the closed configuration and vice versa, said machines do not have sufficient safety measures for the user, exposing him/her to the risk of potential injuries due to the considerable weight of the machine itself.

SUMMARY

In light of the above, it is, therefore, an object of some embodiments of the present invention to provide a gymnastic machine of the above type, having reduced longitudinal overall dimensions in the closed configuration.

Another object of some embodiments of the invention is to provide a gymnastic machine equipped with safety devices that protect the user in the transition from the open configuration to the closed configuration, and vice versa.

A further object of some embodiments of the present invention is to provide a machine that allows a transition from the open configuration to the closed one and vice versa, which is not tiring.

It is, therefore, specific object of some embodiments of the present invention is a foldable gymnastic machine comprising a supporting structure to rest said gymnastic machine on a resting surface, comprising a front portion, comprising in turn a resistance member, and a rear portion, an exercise device, through which a user performs a gymnastic exercise, coupled to said supporting structure and to said resistance member, capable of resisting during the execution of a gymnastic exercise, said exercise device comprising a second pair of levers for the feet, in turn comprising a first and a second lever, each provided with a first end, coupled to said supporting structure, and a free second end, capable of fitting said user's feet during the execution of the gymnastic exercise, said gymnastic machine being characterized in that said first and second lever of said second pair of levers for the feet are capable of passing from an open position, in which the user can perform the gymnastic exercise, to a closed position, when the gymnastic machine is not in use.

Further according to some embodiments of the invention, said rear portion is capable of passing from an open position, when it is placed in contact with said resting surface and positioned along a horizontal direction, to a closed position when it is placed close to said front portion, substantially placed along a vertical direction, orthogonal to said horizontal direction.

Still according to some embodiments of the invention, said rear portion is capable of getting into a safety position while passing from said open position to said closed position, before permanently getting into the open position.

Preferably according to some embodiments of the invention, said rear portion comprises a safety lock, capable of locking said rear portion in said open position and in said safety position.

According to some embodiments of the invention, said safety lock comprises an activation group and a locking group, linked to said activation group, capable of locking said rear portion in said open position and of unlocking said rear portion to pass from said open position to said closed position.

According to some embodiments of the invention, said activation group comprises an activation member, capable of being activated by the user to pass from a closing position, in which said rear portion is locked in the open position, to a safety position, in which said rear portion is in the safety position, to an opening position, in which said rear portion is in the closed position, a jointed arm, connected to said activation member, capable of transferring the movement from said activation member to said locking group, in the several positions assumed by said activation member.

Still according to some embodiments of the invention, said locking group comprises a locking member, and a movable wall, connected to said jointed arm, and capable of passing from a disengagement position, when said activation member is in said opening position, to an engagement position, when said activation member is in said closing position, with said locking member, following the movement caused by said jointed arm.

Preferably according to some embodiments of the invention, said first and second lever comprises a lock/unlock mechanism capable of allowing the passing of said first and second lever for the feet from the open position to the closed position and vice versa.

According to some embodiments of the invention, said lock/unlock mechanism comprises a handle, capable of being used by the user to pass from a resting position, to a working position, wherein said lock/unlock mechanism is activated, a transmission element, connected to said handle and operated by the handle itself, a pin connected to said transmission element and movable in an integral way with it, and an abutment element, capable of receiving said pin in the closed position of said first and second lever for the feet.

Further according to some embodiments of the invention, said gymnastic machine comprises a first pair of levers for the hands, capable of supporting the upper limbs of a user, coupled to said second pair of levers for the feet.

Still according to some embodiments of the invention, the passage of said rear portion from said open position to said closed position is capable of causing the passage of said second pair of levers for the feet from said open position to said closed position.

Finally, according to some embodiments of the invention, said second pair of levers for the feet is coupled to said resistance member via a first and a second cable, in such a way that during the execution of a gymnastic exercise, each lever of said second pair of levers is capable of following an elliptical trajectory.

BRIEF DESCRIPTION OF THE DRAWINGS

Embodiments of the present invention will be now described, for illustrative but not limitative purposes, according to its preferred embodiments, with particular reference to the figures of the enclosed drawings, wherein.

In the various figures, similar parts will be indicated with the same numerical references.

DETAILED DESCRIPTION

Figure 1:
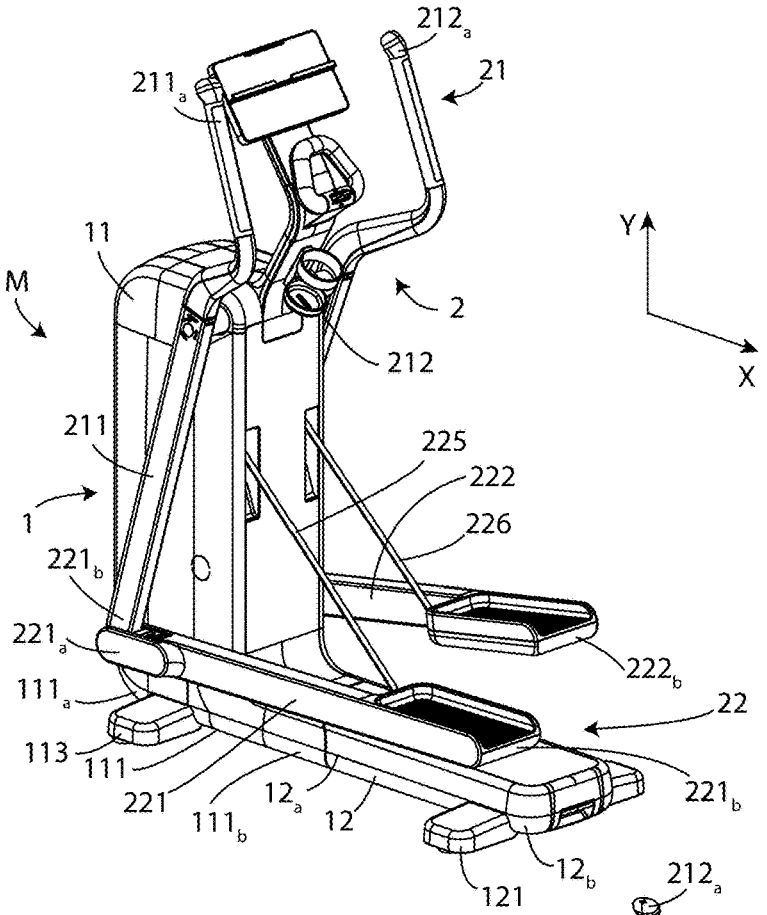
FIG. 1 shows an overall axonometric view of the foldable gymnastic machine in an open configuration.
Figure 2:
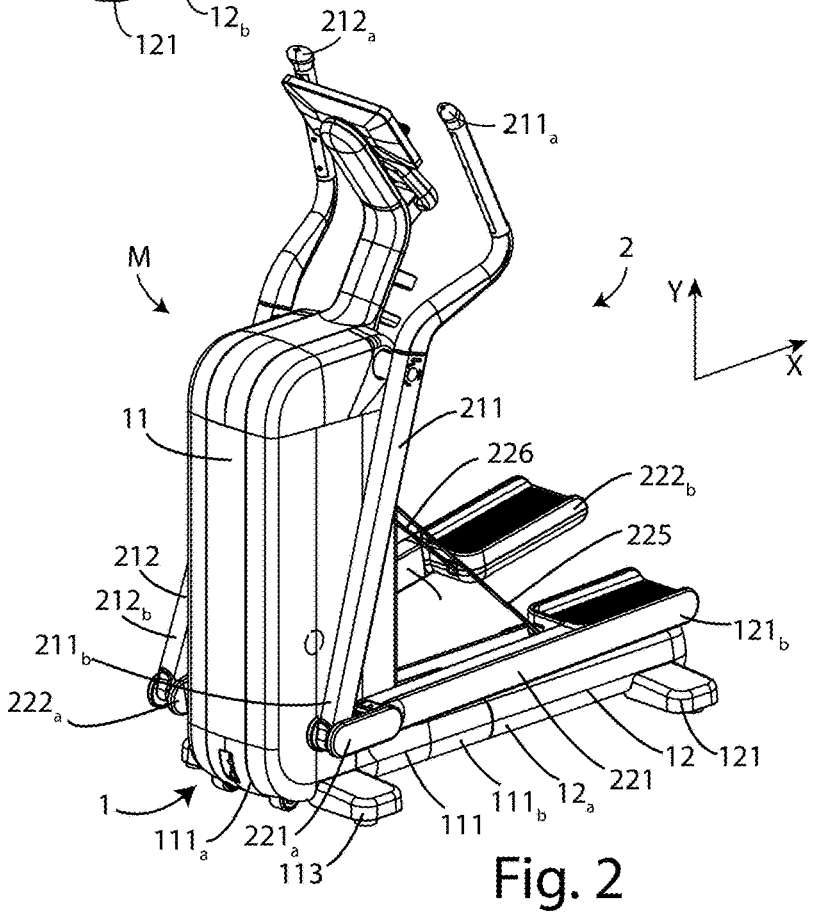
FIG. 2 shows a second overall axonometric view of the foldable gymnastic machine, shown in FIG. 1, in an open configuration.
Figure 3:
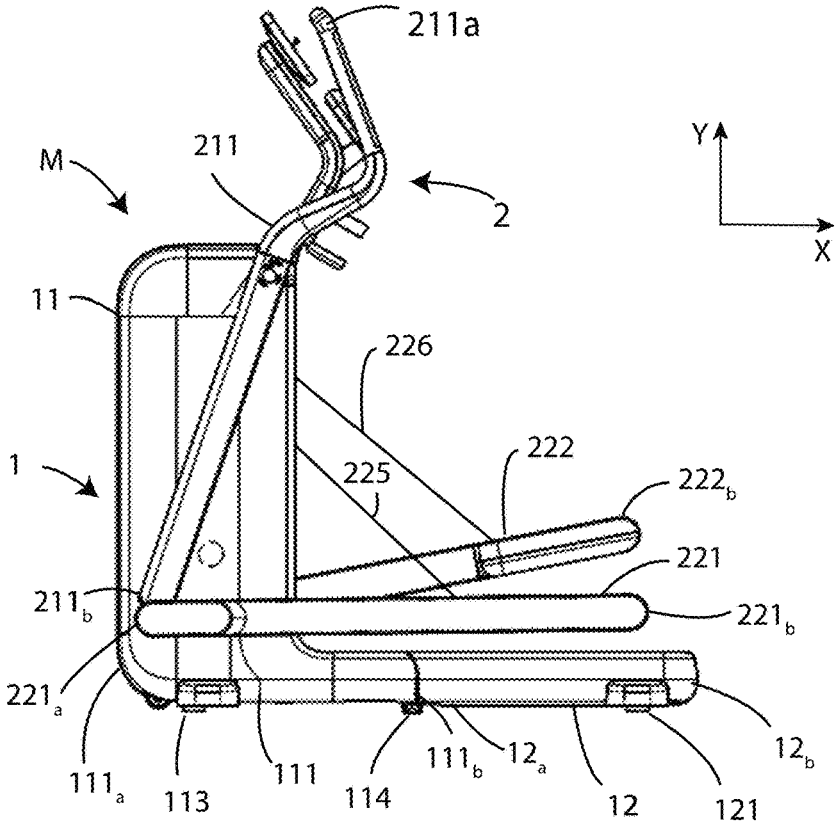
FIG. 3 shows an overall side view of the foldable gymnastic machine, shown in FIG. 1, in the open configuration.
Figure 4:
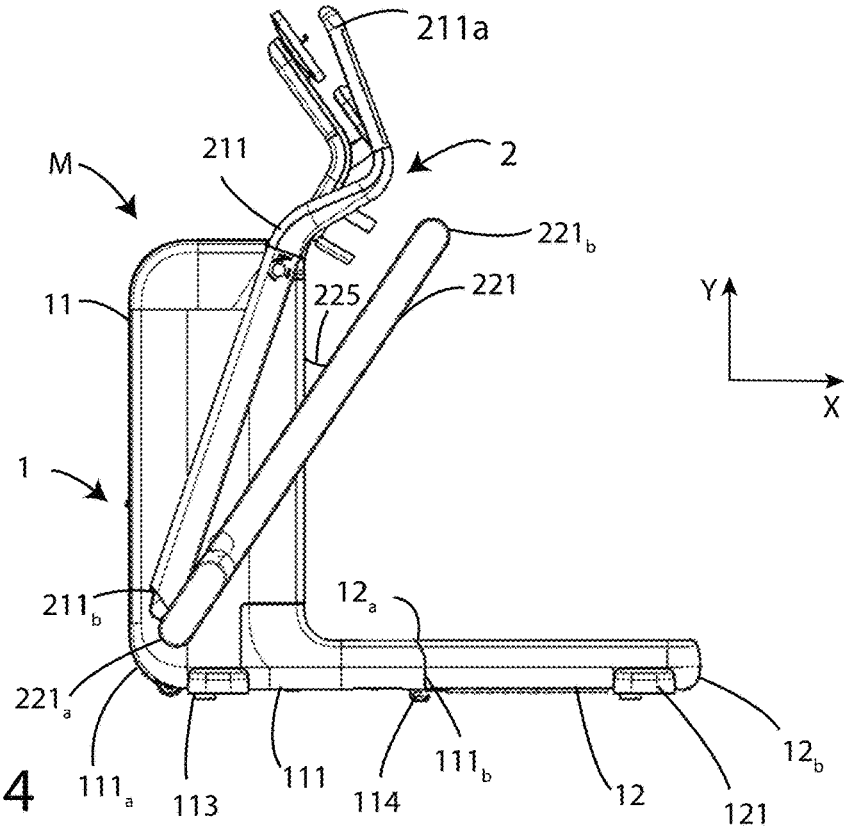
FIG. 4 shows an overall side view of the foldable gymnastic machine, shown in FIG. 1, in a partially closed configuration.
Figure 5:
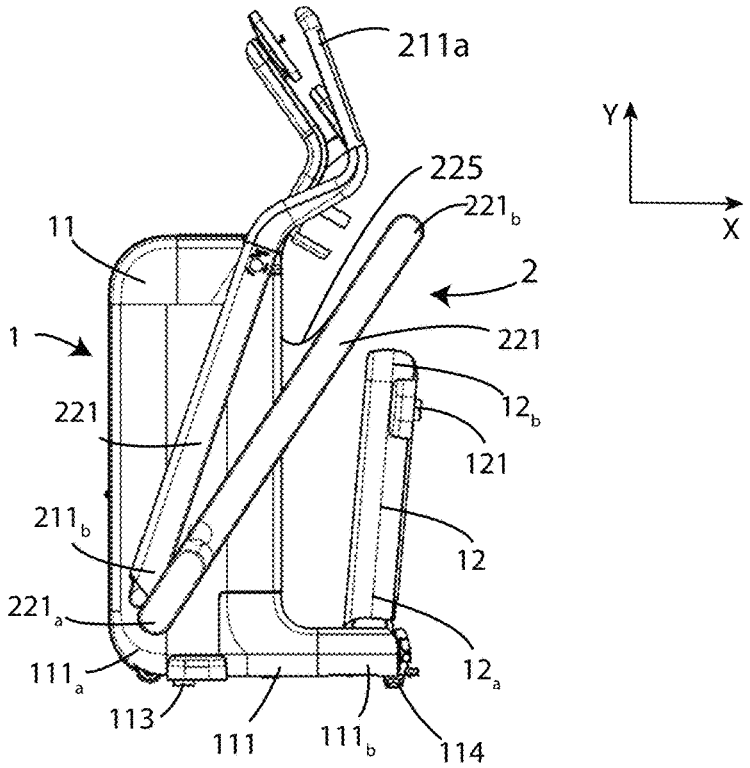
FIG. 5 shows an overall side view of the foldable gymnastic machine, shown in FIG. 1, in a closed configuration.

With reference to the attached figures, the foldable gymnastic machine M comprises a support structure 1, capable of supporting the gymnastic machine M itself, and an exercise device 2, coupled to said support structure 1, which is capable of being operated by a user while performing a gymnastic exercise.

Said support structure 1 comprises a front portion 11, and a rear portion 12, coupled to said front portion 11, which extends along a horizontal direction X.

Said front portion 11 has a L-shaped conformation, with a part extending along a vertical direction Y, perpendicular to said horizontal direction X, and a base 111, for supporting said support structure 1.

Said base 111 is provided with a first end $\mathbf{111}_a$ and a second end $\mathbf{111}_b$.

With particular reference now to FIGS. 5-12, said front portion 11 comprises a base fulcrum 112, a first contact area 113, with a bearing surface, and a support element 114.

Said base fulcrum 112 is arranged in said second end $\mathbf{111}_b$ of said base 111.

Said base fulcrum 112 allows the coupling between said front portion 11 and said rear portion 12, so that said rear portion 12 is able to rotate around said base fulcrum 112 with respect to said portion front 11, on a plane parallel to the XY plane, identified by said horizontal X and vertical Y direction.

Said first contact area 113 is capable of putting said front portion 11 into contact with a support surface, in particular the ground, and to support its weight.

Said support element 114 is a semi-rigid support, arranged in the second end $\mathbf{111}_b$ of said base 111.

Said support element 114 is able to support the weight of said gymnastic machine M and to deform more easily with respect to said first contact area 113, to provide said gymnastic machine M with a planar support, even if the ground under said machine M is not planar.

In said front portion 11 there is a resistant member, such as an electromagnetic brake, not shown in the figure, connected to said operating device 2.

Said electromagnetic brake is capable of opposing a resistance, variable and settable by the user, to said exercise device 2, during the execution of the gymnastic exercise.

Said rear portion 12 is provided with a first end $\mathbf{12}_a$ and a second end $\mathbf{12}_b$.

Said first end $\mathbf{12}_a$ of said rear portion 12 is coupled to said second end $\mathbf{111}_b$ of said base 111, by means of said base fulcrum 112, and it is able to rotate around said base fulcrum 112.

Said rear portion 12 is able to pass from an open position, in which said rear portion 12 is arranged along an axis parallel to said horizontal direction X and resting on the ground and in which it is possible to carry out a gymnastic exercise, to a closed position, in which it is arranged substantially vertically above said base fulcrum 112 and in which the bulk of said gymnastic machine M along said horizontal direction X is minimized, and vice versa.

Said rear portion 12 may comprise a safety locking pin when it is in the closed position.

Said rear portion 12 comprises a second contact area 121 and a safety lock 3.

Said rear portion 12 rests on the ground by means of said second contact area 121.

Said safety lock 3 is arranged in said first end $\mathbf{12}_a$ of said rear portion 12, and is capable of locking said rear portion 12 in said open position.

Figure 9:
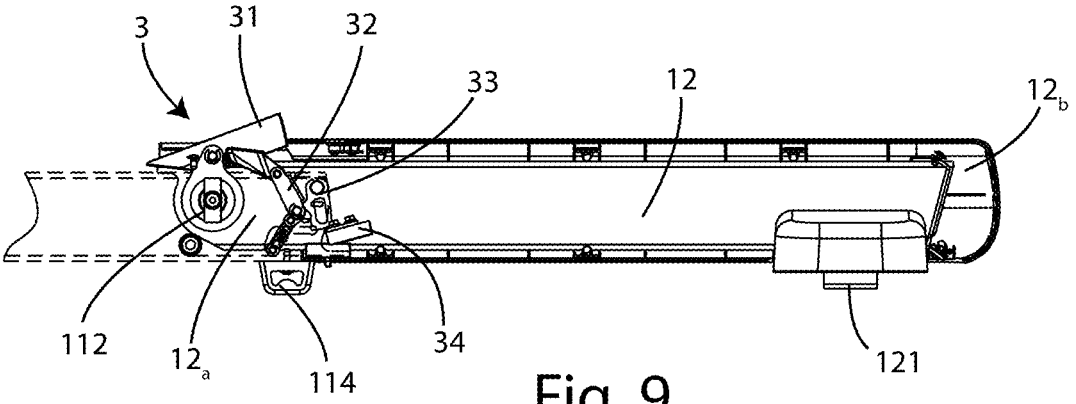
FIG. 9 shows a sectional side view of the component shown in FIG. 7, in a safe open position.
Figure 10:
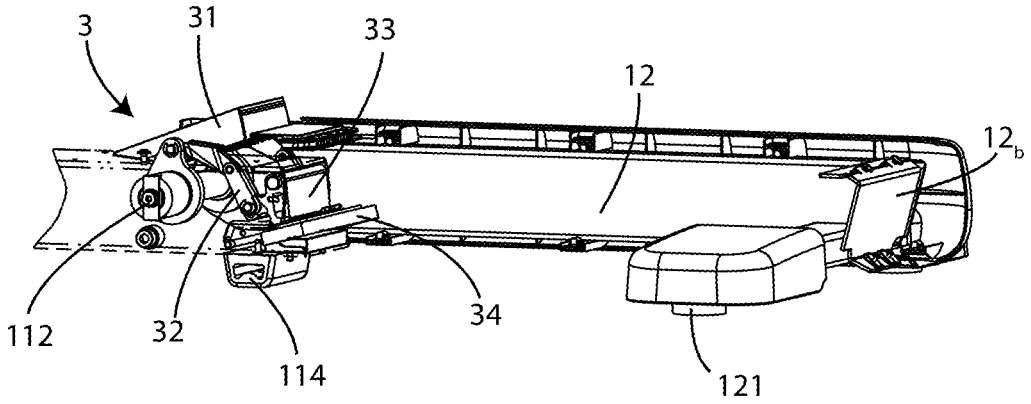
FIG. 10 shows a sectional axonometric view of a component of the foldable gymnastic machine, shown in FIG. 7, in a safe open position.

Said safety lock 3 is able to assume an open position, a safety position, as shown in FIGS. 9 and 10, and a closed position.

With reference in particular to FIGS. 7-12, said safety lock 3 is substantially an articulated-quadrilateral, which, following an actuation, causes the movement of the blocking means for blocking said rear portion 12.

In particular, said safety lock 3 comprises an activation member 31, such as for example a lever or a handle, a jointed arm 32, a movable bulkhead 33, and a locking member 34.

Said activation member 31 is operated by the user and is able to pass from a closed position, in which it locks said rear portion 12 in the open position, to a safety position, in which said rear portion 12 is already in the open position but is not yet unlocked, to an open position, in which said rear portion 12 is in the closed position.

Said jointed arm 32 is connected to said actuation member 32 and it is capable of transferring movement from said activation member 31 to said movable bulkhead 33 in the different positions assumed by said activation member 31.

Figure 7:
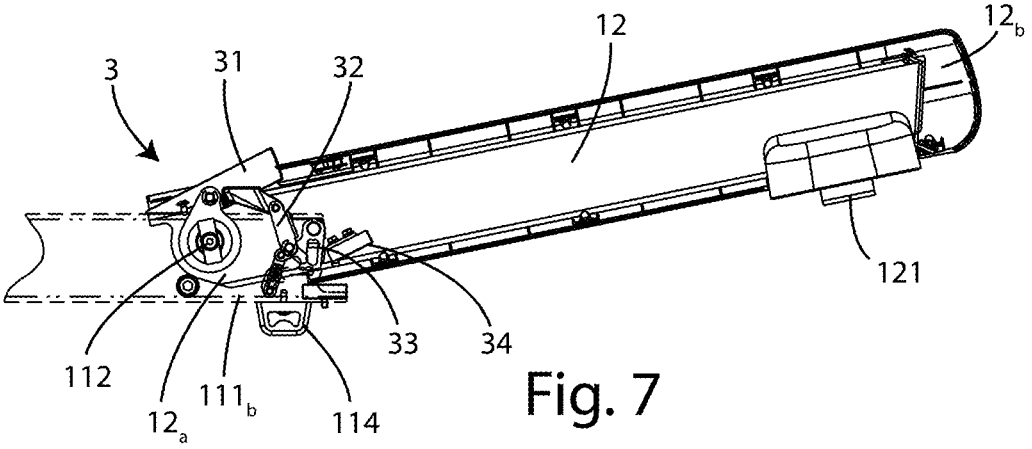
FIG. 7 shows a sectional side view of a component of the foldable gymnastic machine, shown in FIG. 1, in a partially open position.
Figure 8:
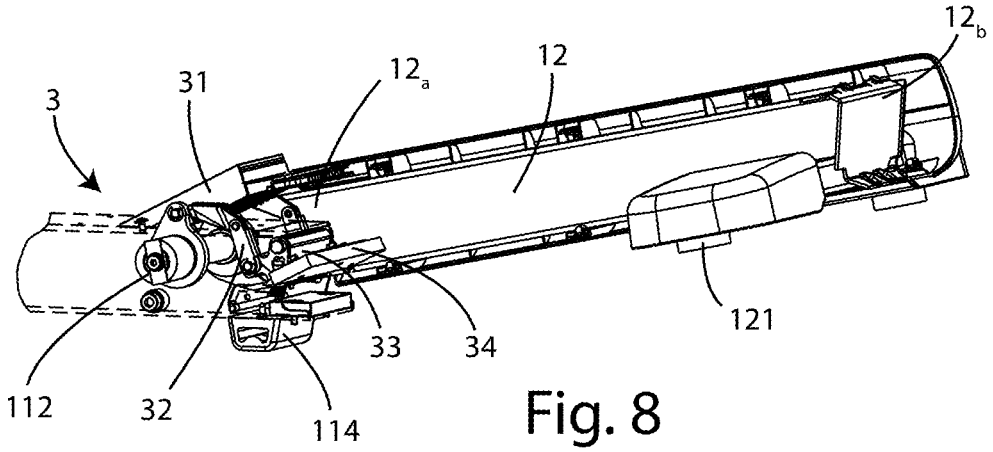
FIG. 8 shows a sectional axonometric view of the component shown in FIG. 7, in a partially open position.
Figure 11:
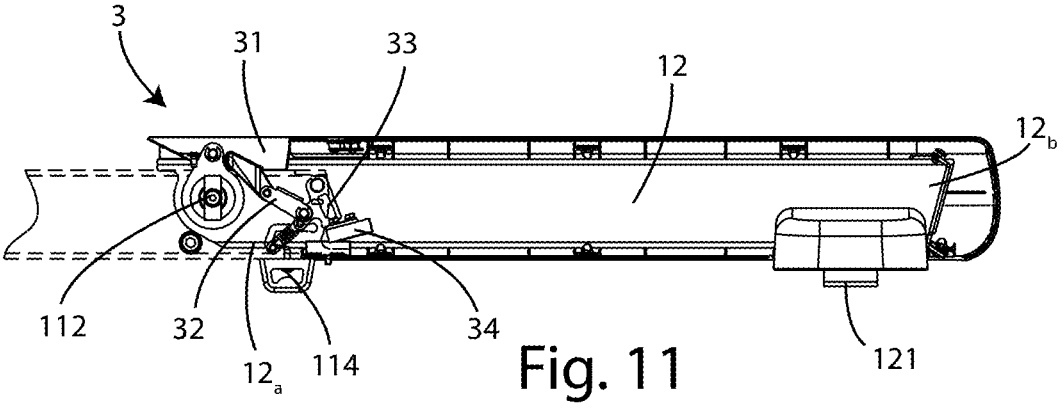
FIG. 11 shows a sectional side view of the component shown in FIG. 7, in an open position.
Figure 12:
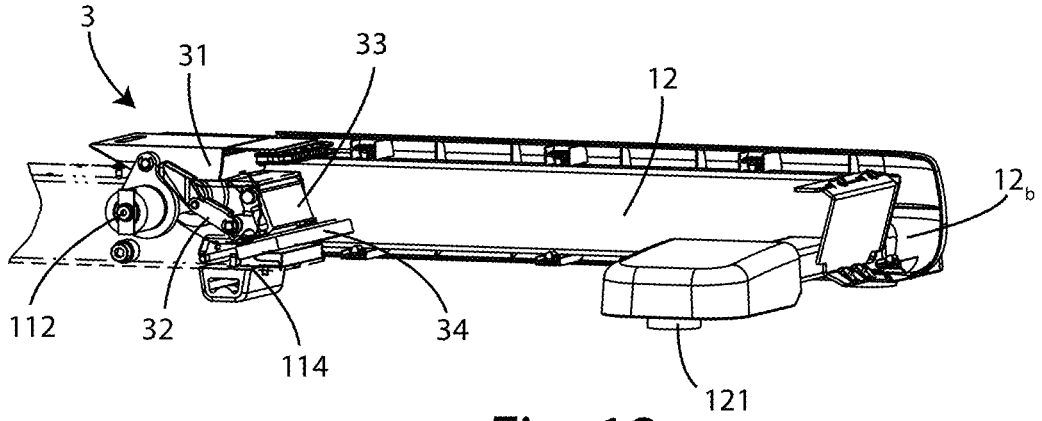
FIG. 12 shows a sectional axonometric view of the component shown in FIG. 7, in an open position.
Figure 13:
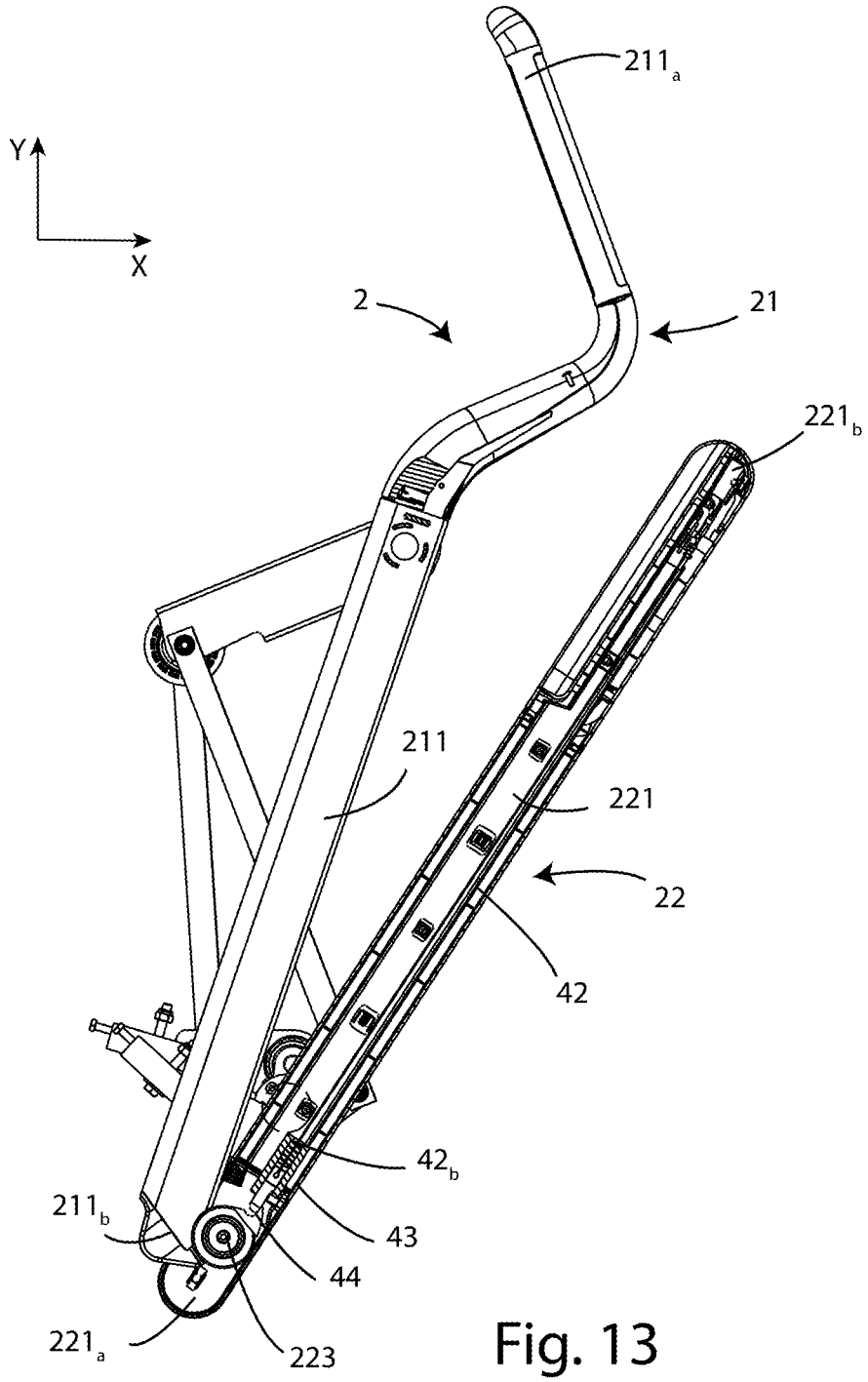
FIG. 13 shows a side view of an operating device of the machine shown in FIG. 1, in a closed position.
Figure 14:
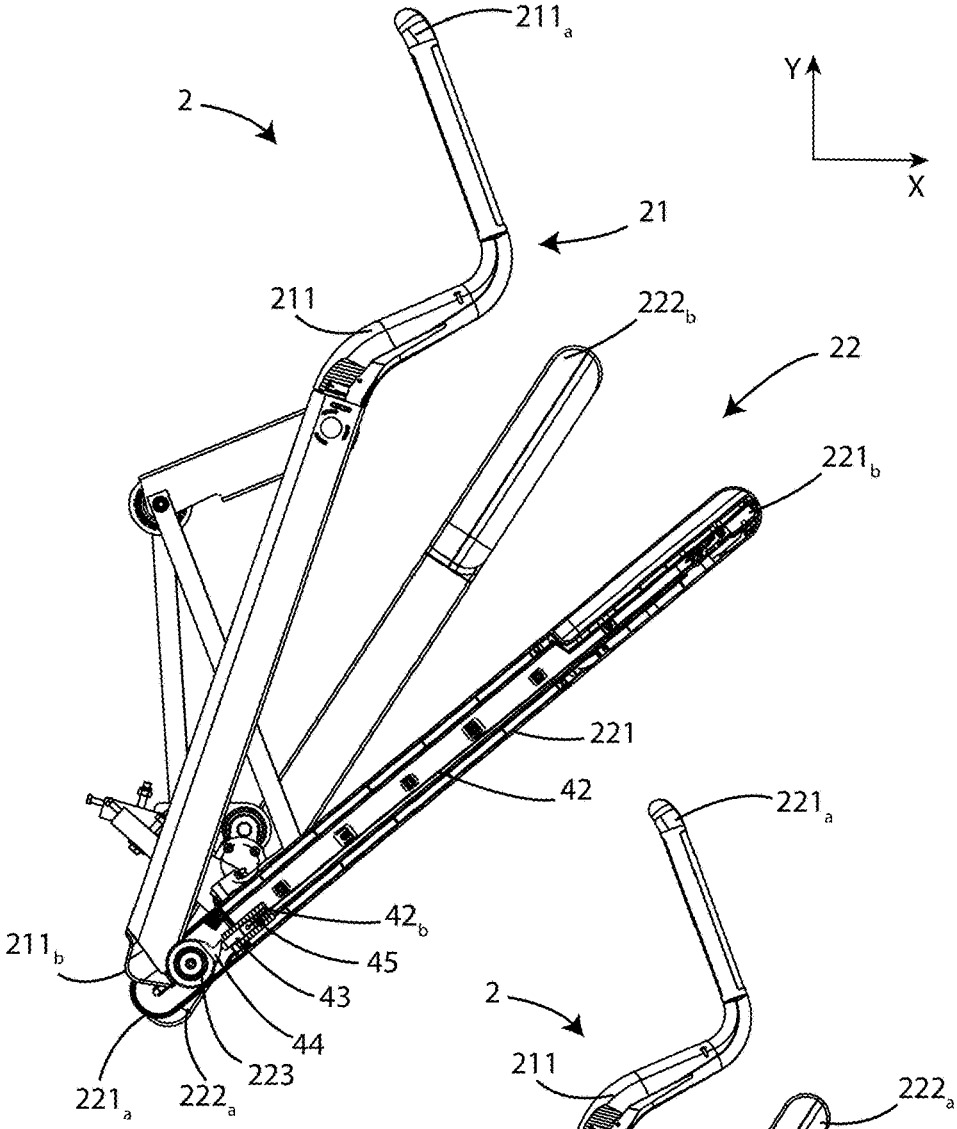
FIG. 14 shows a side view of the device shown in FIG. 13, in a position of transition from the closed configuration to the opening configuration of the machine.
Figure 15:
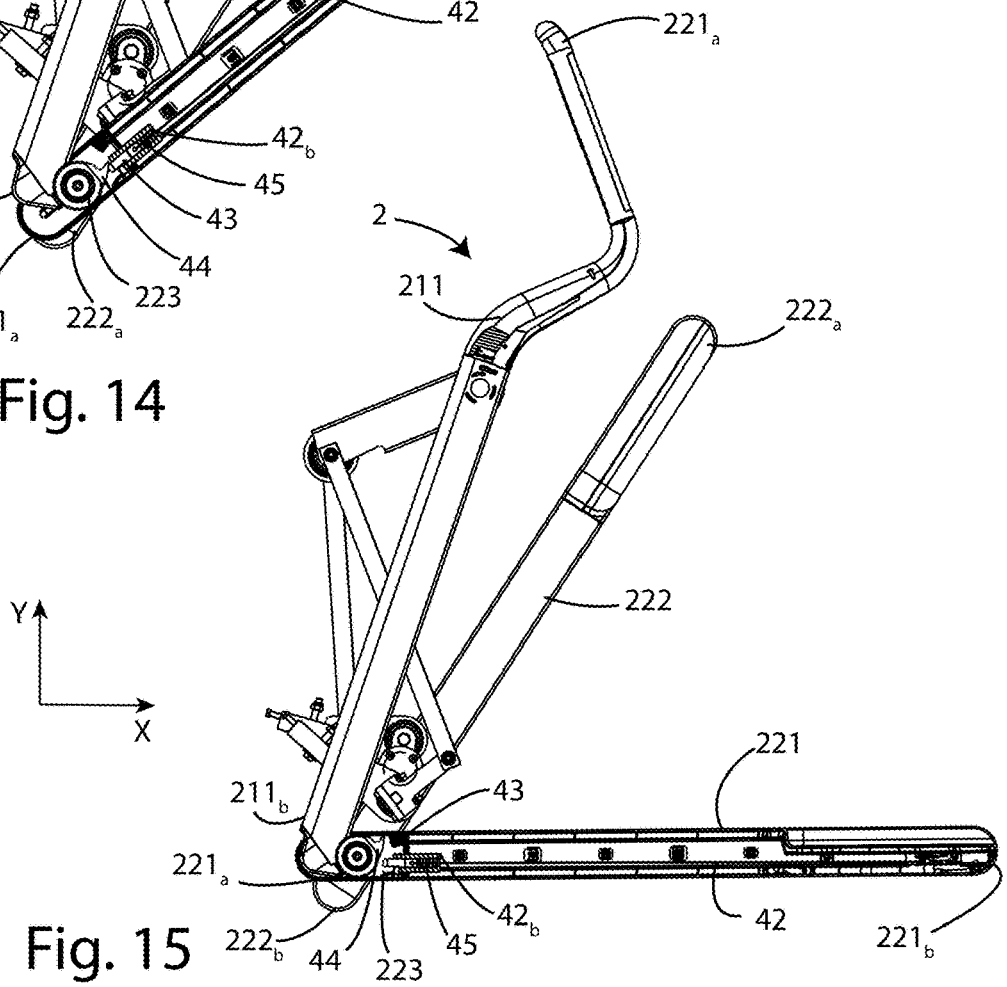
FIG. 15 shows a sectional side view of the machine shown in FIG. 1, in a partially open configuration.
Figure 16A:
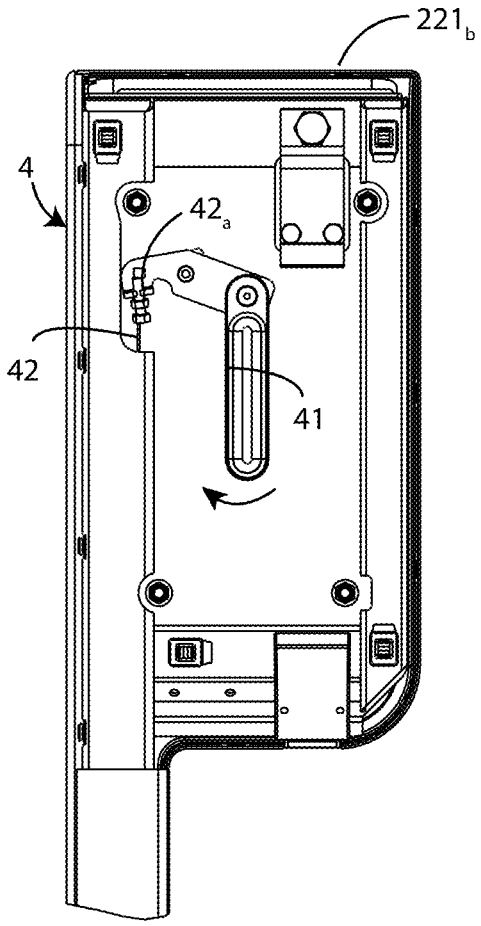
FIG. 16*a* shows a bottom view of a component of the machine shown in FIG. 1, in a first position.
Figure 16B:
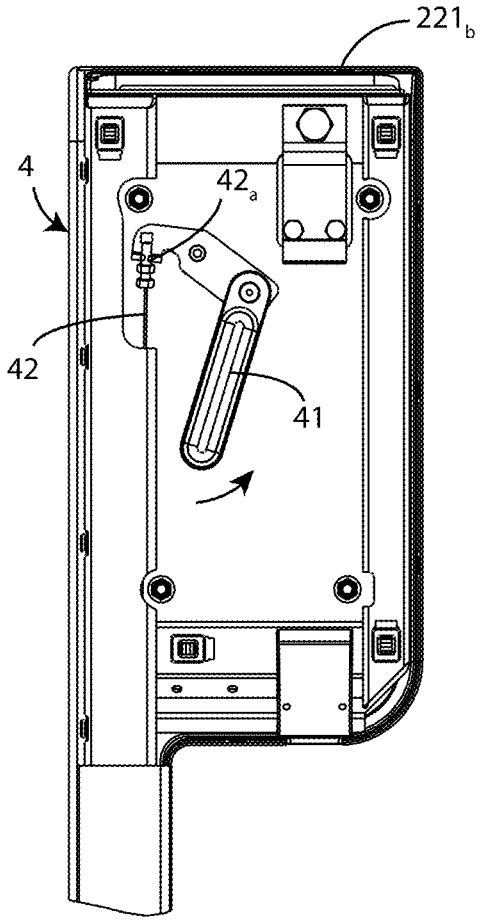
FIG. 16*b* shows a bottom view of the component shown in FIG. 16*a*, in a second position.

Said movable bulkhead 33 is connected to said jointed arm 32 and is able to pass from a disengagement position, as shown in FIGS. 7 and 8, when said activation member 31 is in said open position, to an engagement position, as shown in FIGS. 11 and 12, when said activation member 31 is in said closed position, with said locking member 34, following the movement caused by said jointed arm 32, as will be described in detail below.

Said safety lock 3 comprises an elastic element, such as for example a gas spring, not shown in the figure, coupled between said base fulcrum 112 and said support structure 1, capable of facilitating the lifting of said rear portion 12, from said open position towards said closed position, and supporting said rear portion 12 in said closed position.

Referring now to FIGS. 13-16, said operating device 2 comprises a first pair of levers 21 for the hands and a second pair of levers 22 for the feet, coupled to said base structure 1, and connected to said electromagnetic brake, which they are able to move when operated by the user during the execution of the gymnastic exercise.

Said first pair of hand levers 21 comprises a first hand lever 211 and a second hand lever 212.

In particular, said first hand lever 211 comprises a first end $\mathbf{211}_a$, capable of being gripped by the hand of a user, and a second end $\mathbf{211}_b$.

Said second hand lever 212 comprises a first end $\mathbf{212}_a$, capable of being gripped by the hand of a user, and a second end $\mathbf{212}_b$.

Without departing from the scope of protection, said first ends $\mathbf{211}_a$ and $\mathbf{212}_a$ can also be coupled directly to said support structure and cannot be gripped by the user.

Said first pair of levers 21 for the hands is capable of oscillating on a plane parallel to said plane XY.

Said second pair of levers 22 for the feet comprises a first lever 221 for the feet and a second lever 222 for the feet, each one of which is connected to said resistant member, such as an electromagnetic brake, arranged in said front portion 11, by respectively a first cable 225 and a second cable 226.

Said first cable 225 and second cable 226 are tie rods, which act as end position for said first lever 221 and second lever 222 when they are in the open position.

Said first lever 221 for the feet is provided with a first end $\mathbf{221}_a$, coupled to said second end $\mathbf{211}_b$ of said first lever 211 for the hands, a second free end $\mathbf{221}_b$, and a fulcrum of the lever 223, placed in said first end $\mathbf{221}_a$.

Said second foot lever 222 is provided with a first end $\mathbf{222}_a$, coupled to said second end $\mathbf{212}_b$ of said second hand lever 212, a second free end $\mathbf{222}_b$ and a lever fulcrum 224, placed in said first end $\mathbf{222}_a$.

Each one of said second end $\mathbf{221}_b$ of said first foot lever 221 and said second end $\mathbf{222}_b$ of said second foot lever 222 is capable of accommodating a foot of a user while performing a gymnastic exercise.

Said second pair of levers 22 for the feet is able to pass from an open position, wherein each first lever 221 and second lever 222 is arranged along a direction substantially parallel to said horizontal direction X, and wherein it is possible to carry out a gymnastic exercise, wherein said first 225 and second 226 cables are in tension, in a closed position, wherein said first pair of hand levers 21 is approached and said first 225 and second 226 cables are slow.

Each of said first 221 and second 222 lever for the feet comprises a lock/unlock mechanism 4, capable of respectively locking said first lever 221 for the feet and second lever 222 for the feet in the closed position, and unlocking it, to allow the passage from the closed position to the open position.

For ease of description, the lock/unlock mechanism 4 of said first lever 221 for the feet is described, however also said second lever 222 for the feet comprises an identical lock/unlock mechanism 4.

Referring in particular also to FIGS. $\mathbf{16}_a$ and $\mathbf{16}_b$, said lock/unlock mechanism 4 comprises a handle 41, arranged in said second end $\mathbf{221}_b$ of said first lever 221 for the feet, a transmission element 42, which extends between said first $\mathbf{221}_a$ and second $\mathbf{222}_b$ end, a pin 43 and an abutment element 44.

Said handle 41 is able to pass from a rest position to a working position, in which it activates said lock/unlock mechanism 4, and vice versa.

Said lock/unlock mechanism 4 can comprise an unlocking pin to enable said handle 41.

Said transmission element 42 is provided with a first end $\mathbf{42}_a$, arranged in said second end $\mathbf{221}_b$ of said first lever 221 for the feet, capable of being connected to said handle 41, and a second end $\mathbf{42}_b$, arranged in said first end $\mathbf{221}_a$ of said first foot lever 221, which said pin 43 is coupled to.

In correspondence with said second end $\mathbf{221}_b$, a spring 45 is arranged, capable of pushing said pin 43 towards said abutment element 44.

Said abutment element 44 is integral with said first lever 211 of said first pair of levers 21 for the hands.

Said abutment element 44 has an external surface and a cavity, which is able to house said pin 43 in the closed position of said first lever 221.

Said transmission element 42 is able to actuate said pin 43, towards and away from said abutment element 44.

In particular, when said first lever 221 is in the open position, said pin 43 is distant from said abutment element 44, while passing from the open position to the closed position it is capable of sliding on the surface of said abutment element 44, remaining in contact with said abutment element 44 thanks to the force exerted by said spring 45, and in the closed position it is housed in the cavity of said abutment element 44, due to the force exerted by said spring 45.

During the execution of a gymnastic exercise, each end of the lever of said second pair of levers 22 is capable of moving along an elliptical trajectory on a plane parallel to said XY plane.

Said first fulcrum of the lever 223 is capable of rotatably coupling said first lever 221 for the feet with said first lever 211 for the hands, to allow the relative movement of said first lever 221 for the feet with respect to said first lever 211 for the hands, for the execution of the exercise and the passage of said first lever 221 for the feet from the open position to the closed position and vice versa.

Similarly, said lever fulcrum 224 is capable of rotatably coupling said second lever 222 for the feet with said second lever 212 for the hands, to allow the relative movement of said second lever 222 for the feet with respect to said second lever 212 for the hands, for the execution of the exercise and the passage of said second lever 222 for the feet from the open position to the closed position and vice versa.

Said gymnastic machine M is in an open configuration when said rear portion 12 is in the open position and said second pair of levers 22 is in the open position.

Said gymnastic machine M is in a closed configuration when said rear portion 12 is in closed position and said second pair of levers 22 is in closed position.

Figure 6:
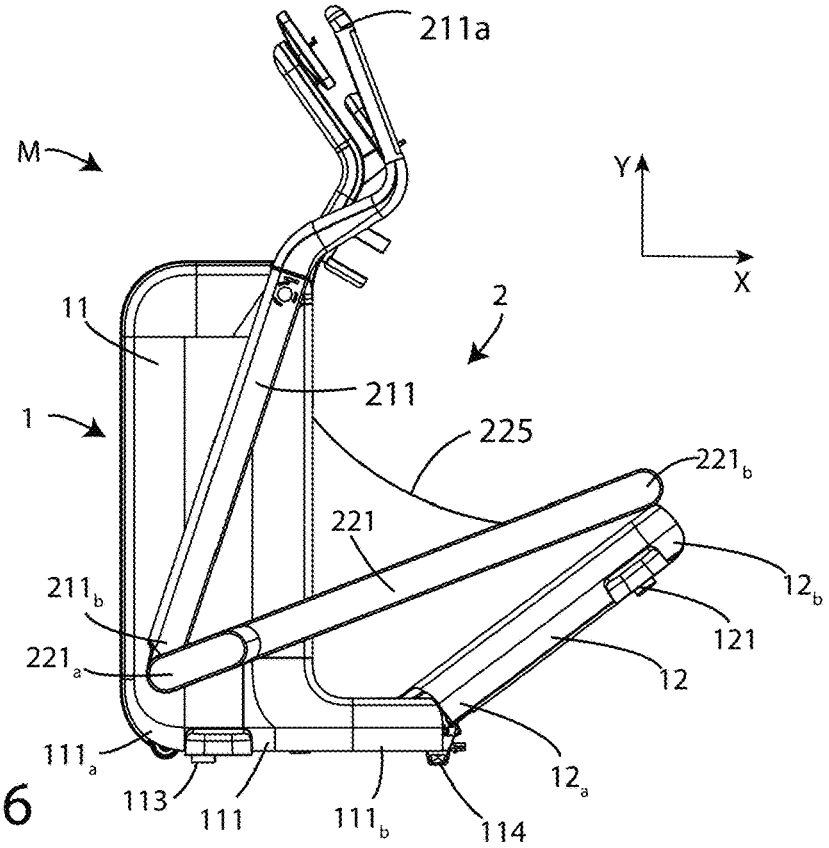
FIG. 6 shows an overall side view of the foldable gymnastic machine, in a transition position from the open configuration to the closed configuration, in the transition between the open configuration and the closed configuration.

Referring in particular to FIG. 6, the passage of said first lever 221 for the feet and second lever 222 for the hands, from said open position to said closed position, can also take place simultaneously and due to the passage of said rear portion 12 from said open position to said closed position.

The operation of the foldable gymnastic machine M described above, is as follows.

When a user wishes to carry out a stationary simulation walking or running gymnastic exercise, he/she accesses said gymnastic machine M in an open configuration.

In particular, the user positions his/her feet on said second pair of levers 22 for the feet and his/her hands on said first pair of levers 21 for the hands, gripping said first end $\mathbf{211}_a$ of said first lever 211 for the hands and said first end $\mathbf{212}_a$ of said second hand lever 212.

The user then begins to move said second pair of levers 22 for the feet and said first pair of levers 21 for the hands, simulating the movement of a walk or run.

The movements performed during the gymnastic exercise are made tiring by said electromagnetic brake, which opposes the movement of said exercise device 2.

When the user has finished the gymnastic exercise, he/she gets off said gymnastic machine M.

To reduce the encumbrance along said horizontal direction X of said gymnastic machine M, when not in use, the user moves the gymnastic machine M from said open configuration to said closed configuration.

To this end, in particular, the user moves first said second pair of levers 22 from said open position to said closed position, and then said rear portion 12 from said open position to said closed position.

Even more particularly, the user raises said second pair of levers 22 for the feet bringing it towards said first pair of levers 21.

For each one of said first 221 and second 222 lever for the feet, said pin 43 slides on the surface of said abutment element 44, until it reaches the cavity of said abutment element 44 and is positioned inside it pushed by said spring 45, to ensure the blocking of said second pair of levers 22 for the feet, in the closed position.

Subsequently, the user activates said safety lock 3.

In particular, the user activates said activation member 31 to make it pass from said closed position to said safety position.

Subsequently, the user passes said activation member 31 from said safety position to said open position.

In particular, said jointed arm 32 transfers the movement from said activation member 31 to said movable bulkhead 33.

Said mobile bulkhead 33 then passes from said engagement position with said locking member 34 to said disengagement position.

Said rear portion 12 is consequently capable of passing to said closed position.

In particular, the user lifts said second end $\mathbf{12}_b$ of said rear portion 12, which rotates around said base fulcrum 112 until it is arranged substantially vertically above said base fulcrum 112.

If there is a locking pin, said rear portion 12 remains locked in said closed position.

Said gymnastic machine M is therefore in said closed configuration, in which said rear portion 12 is in the closed position and said second pair of levers 22 is in the closed position.

When the user intends to perform a gymnastic exercise again, he/she first passes said rear portion 12 from said closed position to said open position.

In particular, the user grasps said second end $\mathbf{12}_b$ of said rear portion 12 and makes it rotate around said base fulcrum 112 until it is arranged in proximity to the supporting surface.

Said activation member 31 automatically passes into said safety position, in which said rear portion 12 is already in the open position, but it has not yet been locked.

Furthermore, said movable bulkhead 33 passes from said disengagement position to said engagement position, with said locking member 34.

The user then exerts a force on said activation member 31 to make it pass from said safety position to said closed position, in which it locks said rear portion 12 in the open position.

In the passage from said safety position to said closed position of said activation member 31, said support element 114 is deformed, so as to provide said gymnastic machine M with a planar support, even in the case in which the ground underlying said gymnastic machine M is not planar.

The user then passes said second pair of levers 22 from said closed position to said open position.

In particular, the user passes said handle 41 of said locking/unlocking mechanism 4 from said rest position to said working position.

Said handle 41 then actuates, through said transmission element 42, said pin 43, moving it away from said abutment element 44.

Said first lever 221 of said second pair of levers 22 can therefore pass from said closed position to said open position.

In particular, said first lever 221 of said second pair of levers 22 is lowered by the user, by rotating around said first fulcrum of lever 223 until said open position is reached, in which said first cable 225 is under tension.

The same procedure is repeated with said second lever 222 of said second pair of levers 22.

In particular, the user operates said locking/unlocking mechanism of said second lever 222.

Said second lever 222 of said second pair of levers 22 can therefore pass from said closed position to said open position.

Even more particularly, said second lever 222 of said second pair of levers 22 is lowered by the user, by rotating around said second lever fulcrum 224 until said open position is reached, in which said second cable 226 is under tension.

Said second pair of levers 22 is therefore in said open position and said gymnastic machine M is in said open configuration.

The user can then access said gymnastic machine M again in an open configuration and perform a gymnastic exercise.

In a second embodiment, it is also possible that the transition from the open configuration to the closed configuration of said gymnastic machine M takes place by simultaneously bringing said rear portion 12 and said second pair of levers 22 from the open position to the closed position.

In this case, in particular, the user initially moves said rear portion 12 from said open position towards said closed position.

At the same time, said rear portion 12 comes into contact with said second pair of levers 22 and therefore together continue the passage towards said closed position until said gymnastic machine M is in a closed configuration.

A first advantage of the gymnastic machine M is the possibility of having a foldable gymnastic machine, capable of passing from an open configuration to a closed configuration, having reduced longitudinal overall dimensions.

Another advantage is the possibility of having a machine that allows a transition from the open configuration to the closed one and vice versa, which is not tiring.

A further advantage of the gymnastic machine M is the possibility of having safety devices, which protect the user in the passage from the open configuration to the closed configuration and vice versa.

What is claimed is:

1. A foldable gymnastic machine comprising:

a supporting structure to rest said gymnastic machine on a resting surface, the supporting structure comprising a front portion, a resistance member, and a rear portion, and an exercise device, through which a user is capable of performing a gymnastic exercise, coupled to said supporting structure and to said resistance member, the resistance member capable of providing resistance during execution of a gymnastic exercise, said exercise device comprising a second pair of levers, the second pair of levers comprising a first and a second lever, each provided with a first end, coupled to said supporting structure, and a free second end, capable of receiving said user's feet during the execution of the gymnastic exercise, wherein said first lever and said second lever of said second pair of levers are capable of passing from an open position, in which the user can perform the gymnastic exercise, to a closed position, when the gymnastic machine is not in use; and wherein said second pair of levers are coupled to said resistance member via a first cable and a second cable, respectively, in such a way that during the execution of the gymnastic exercise, each lever of said second pair of levers is capable of following an elliptical trajectory.

2. The foldable gymnastic machine according to claim 1, wherein said rear portion is capable of passing from an open position, when it is placed in contact with said resting surface and positioned along a horizontal direction, to a closed position when it is placed close to said front portion, substantially placed along a vertical direction, orthogonal to said horizontal direction.

3. The foldable gymnastic machine according to claim 2, wherein said rear portion is capable of getting into a safety position, while passing from said open position to said closed position, before completely getting into the open position.

4. The foldable gymnastic machine according to claim 3, wherein said rear portion comprises a safety lock, capable of locking said rear portion in said open position and in said safety position.

5. The foldable gymnastic machine according to claim 4, wherein said safety lock comprises an activation group and a locking group, the locking group linked to said activation group and capable of locking said rear portion in said open position and of unlocking said rear portion to pass from said open position to said closed position.

6. The foldable gymnastic machine according to claim 5, wherein said activation group comprises:

an activation member, capable of being activated by the user to pass from the open position to the safety position, and to the closed position, and a jointed arm, connected to said activation member, the jointed arm capable of transferring movement from said activation member to a locking group, in the open position, the safety position, and the closed position assumed by said activation member.

7. The foldable gymnastic machine according to claim 6, wherein said locking group comprises:

a locking member, and a movable bulkhead, connected to said jointed arm, and capable of passing from a disengagement position, when said activation member is in said open position, to an engagement position, when said activation member is in said closed position, with said locking member, following the movement caused by said jointed arm.

8. The foldable gymnastic machine according to claim 1, wherein said first lever and said second lever comprise a lock/unlock mechanism capable of allowing the passing of said first lever and said second lever from the open position to the closed position and vice versa.

9. The foldable gymnastic machine according to claim 8, wherein said lock/unlock mechanism comprises:

a handle, capable of being used by the user to pass from a resting position to a working position, wherein said lock/unlock mechanism is activated in said working position, a transmission element, connected to said handle and operated through the handle, a pin connected to said transmission element and movable in an integral way with it, and an abutment element, capable of receiving said pin in the closed position of said first and second lever.

10. The foldable gymnastic machine according to claim 1, further comprising a first pair of levers, capable of supporting upper limbs of a user, the first pair of levers coupled to said second pair of levers.

11. The foldable gymnastic machine according to claim 1, wherein passage of said rear portion from a first position to a second position is capable of causing passage of said second pair of levers from said open position to said closed position.

* * * * *